United States Patent [19]

Grabner et al.

[11] 4,219,227

[45] Aug. 26, 1980

[54] LOCKABLE DOOR LOCK FOR MOTOR VEHICLES

[75] Inventors: Christian Grabner, Gechingen; Rolf Krügener, Sindelfingen; Dieter Feichtiger, Aidlingen; Rüdiger Hoffmann; Hermann W. Kurth, both of Sindelfingen, all of Fed. Rep. of Germany

[73] Assignee: Daimler-Benz Aktiengesellschaft, Fed. Rep. of Germany

[21] Appl. No.: 8,250

[22] Filed: Feb. 1, 1979

[30] Foreign Application Priority Data

Feb. 3, 1978 [DE] Fed. Rep. of Germany ..... 2804613

[51] Int. Cl.[2] ..... E05C 3/26

[52] U.S. Cl. ..... 292/216; 292/201

[58] Field of Search ..... 292/144, 201, 216, 280, 292/210, 198

[56] References Cited

U.S. PATENT DOCUMENTS

| | | | |
|---|---|---|---|
| 3,113,447 | 12/1963 | Oiskei | 292/201 X |
| 3,565,476 | 2/1971 | Berman | 292/201 |
| 3,905,627 | 9/1975 | Fujita | 292/216 |
| 3,917,330 | 11/1975 | Quanty | 292/201 X |

*Primary Examiner*—Richard E. Moore

*Attorney, Agent, or Firm*—Craig & Antonelli

[57] ABSTRACT

A latchable door lock for motor vehicles, whose catch element, in addition to be blocked by a locking pawl to be actuated manually, is to be blocked by a further latching element, whose blocking action can be lifted only by means of a fitting key; the further latching element thereby engages directly at the catch element without reaction on the locking pawl while the key-controlled commands are transmitted by way of lines to servo devices coordinated to the remaining doors and/or flaps and displacing the additional latching elements.

12 Claims, 4 Drawing Figures

LOCKABLE DOOR LOCK FOR MOTOR VEHICLES

The present invention relates to a latchable door lock for motor vehicles, whose catch element, in addition to being blocked by a latching element in the form of a locking pawl or detent to be actuated manually, is to be blocked by a further latching element, whose blocking effect can be cancelled out or lifted only by means of a fitting key, whereby a prelocking of a lock so constructed is possible at least on the co-driver side.

Such a door lock, which is particularly secure against unauthorized opening, is described in the German Pat. No. 1,226,907, whereby a locking element constructed as pivotal catch is connected with a locking disk. A latching pawl or locking detent can be brought into engagement with the locking disk during the locking of the door from the outside or during actuation of the internal locking means. In addition to this safeguard, a locking mechanism actuated exclusively by a key is provided, whereby during the engagement thereof a bell crank—controlled by a locking slide member—so engages with its free end the latching pawl or detent from below that the door lock cannot be opened by an actuation of the interior locking means.

It is disadvantageous with this prior art construction that in addition to the catch element, properly speaking, a locking disk is necessitated as additional structural part whose connection with the catch element must be so constructed that the occurring forces can be transmitted safely. Furthermore, it is disadvantageous that with a prelocked door, the bell crank is necessarily so controlled by the locking disk during the closing operation that te additional safety effect is cancelled out. Notwithstanding the prelocking, the respective door has to be secured in the closed condition by a rotation of the key.

It is the aim of the present invention to at least better secure the door locks of a motor vehicle against unauthorized opening without incurring special expenditures and by circumventing the aforementioned disadvantages and to assure in connection with locks having a prelocking mechanism that the prelocked, secured closed position is still effective also after the corresponding door is slammed closed.

Consequently, a door lock of the aforementioned type is proposed, whereby according to the present invention the further latching element engages directly at the catch element without feedback or reaction on the latching pawl or detent, and whereby the key-controlled commands are transmitted by way of lines to the remaining servo devices which are coordinated to doors and/or flaps and which actuate the additional latching elements.

It is thereby of advantage if the additional latching element, while being acted upon and loaded by the catch element, is supported at a fixed point of the lock housing without exerting a load on a control valve and/or on the servo devices.

The fixed point may be formed by the bearing pin of the pivotally arranged catch element which may be constructed as lever.

In one embodiment of the present invention, the servo device consists of a pneumatic element such as, for example, of a vacuum element, whose shifting rod, adapted to be shortened against spring force, is pivotally connected at its free end with a latching pawl or detent which serves as latching element.

In another embodiment of the present invention, the servo device is constructed as pulse-controlled electromagnet whose extended armature that is held in its end positions by a bistable spring having a dead-center position is pivotally connected at an arm of a two-armed lever constructed hinge-like and representing the latching element, which is adapted to be displaced into a deflected position against spring force.

Accordingly, it is an object of the present invention to provide a door lock for motor vehicles adapted to be latched which avoids by simple means the aforementioned shortcomings and drawbacks encountered in the prior art.

Another object of the present invention resides in a lockable door lock for motor vehicles which is simple in construction, minimizes the number of parts required and is highly effective to prevent unauthorized opening.

A further object of the present invention resides in a door lock for a motor vehicle which is better secured against unauthorized openings or break-ins, yet maintains effective the prelocked condition even after the door is thrown closed.

A still further object of the present invention resides in a latchable door lock of the type described above in which an unauthorized opening of the door is prevented by rotation of the key actuating an additional latching element which can be unlatched again only by the use of the key.

These and further objects, features and advantages of the present invention will become more apparent from the following description when taken in connection with the accompanying drawing which shows, for purposes of illustration only, two embodiments in accordance with the present invention, and wherein.

Figure 2:
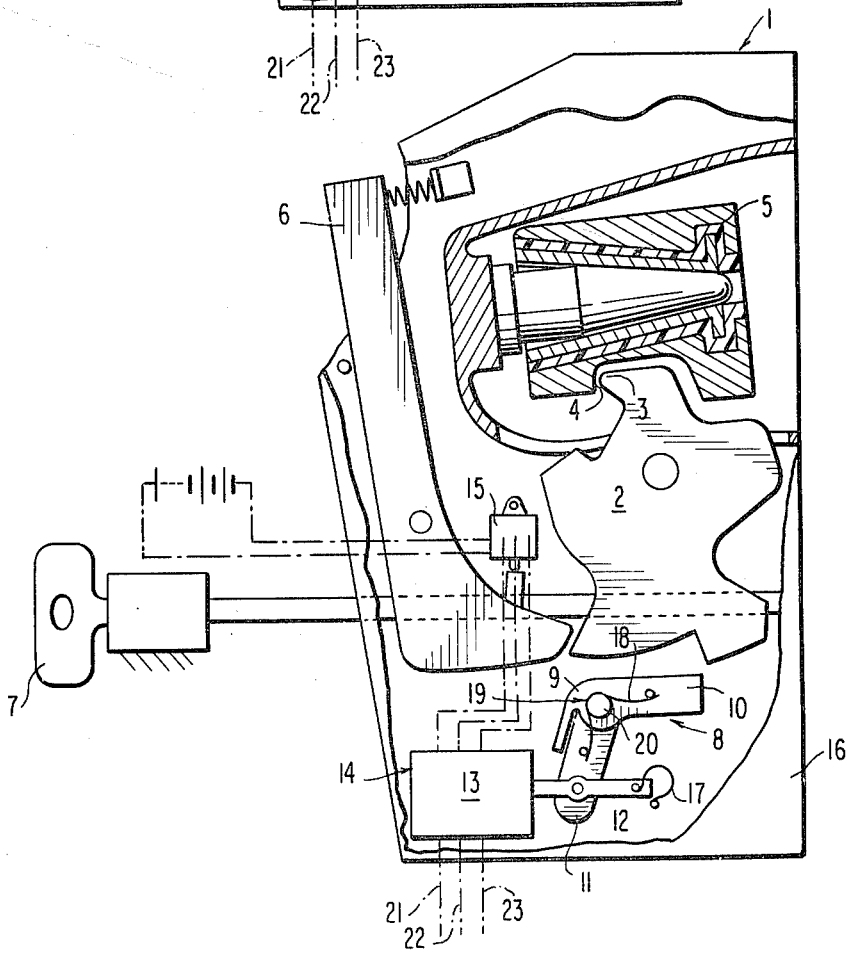
FIG. 2 is a schematic view, similar to FIG. 1, with the additional latching element in the inoperable position.
Figure 3:
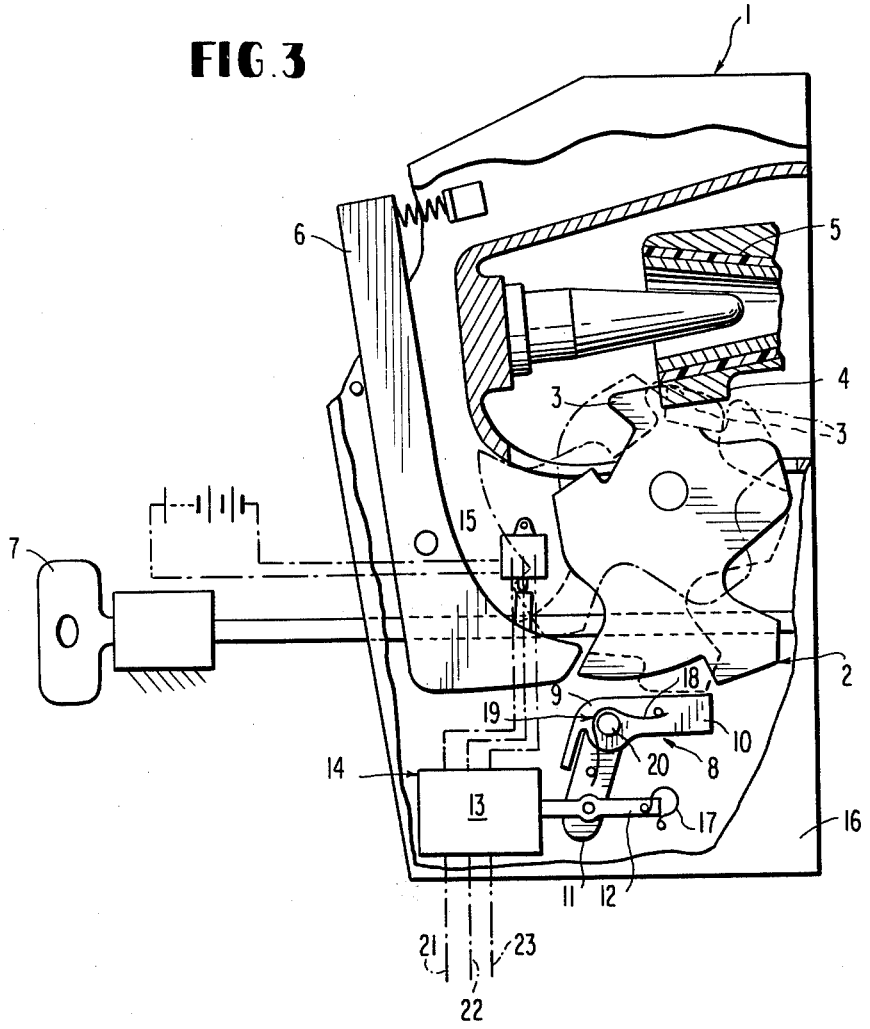
Figure 4:
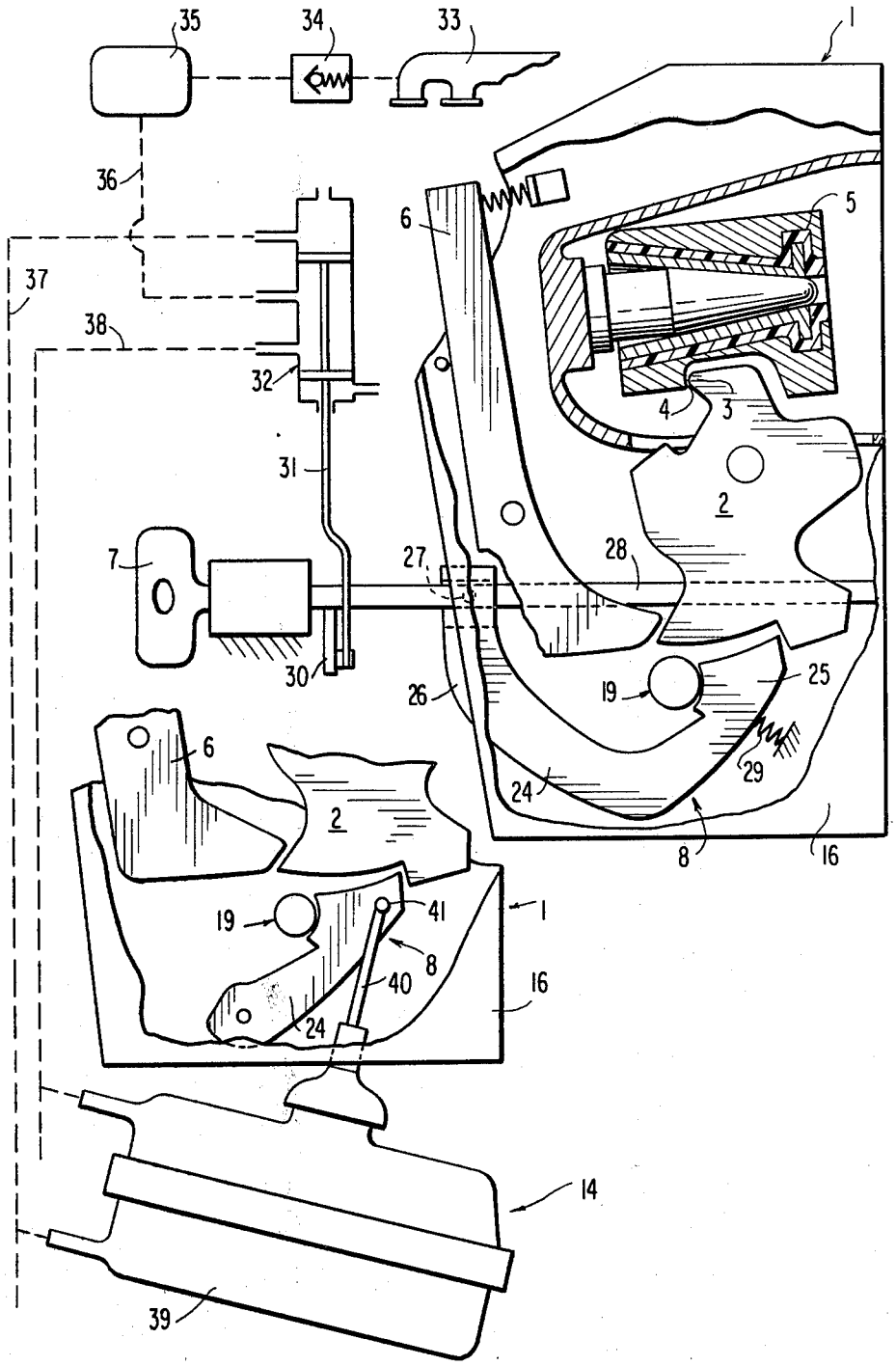

FIG. 3 is a somewhat schematic view, similar to FIG. 2, which indicates the movement of the catch element during the closing operation of the door by illustrating in full line, in dash line and in dash-and-dotted lines three positions thereof; and FIG. 4 is a schematic view, partly in cross section, of a second embodiment of a motor vehicle door lock in accordance with the present invention with an additional latching element and a transmission of the adjusting movement to vacuum elements coordinated to the remaining locks.

Referring now to the drawing, wherein like reference numerals are used throughout the various views to designate like parts, a tapered cone door lock generally designated by reference numeral 1 which is indicated only schematically, includes a catch element generally designated by reference numeral 2 which is supported with its nose portion 3 at a support surface 4 of a closing eye or lug 5 fixed at the body, when the door is properly closed.

A latching member 6 in the form of a latching pawl or detent can be held in a manner not shown herein in the illustrated latching position brought about by spring action by way of a locking pin (not shown) located in proximity of the window and by a corresponding rotation of the key 7. For purposes of opening the door from the inside of the vehicle, a pivot handle (not shown) which is inset into the inner door covering and which acts on the latching pawl 6 is actuated, whereby during this actuation, the locking pin is automatically unlocked. If the door is to be opened from the outside, then the key 7 is rotated into the corresponding position whereby again the locking pin is automatically unlocked. By a subsequent pressing in of a push-button (not shown), the support action of the latching pawl 6 is lifted, and the door can be swung open. The illustrated door lock 1 can be prelocked with an open door which, however, is frequently possible only on the co-driver side, whereby the latching pawl 6 springily deflects during the closing of the door when the catch 2 abuts thereagainst (FIG. 3).

Figure 1:
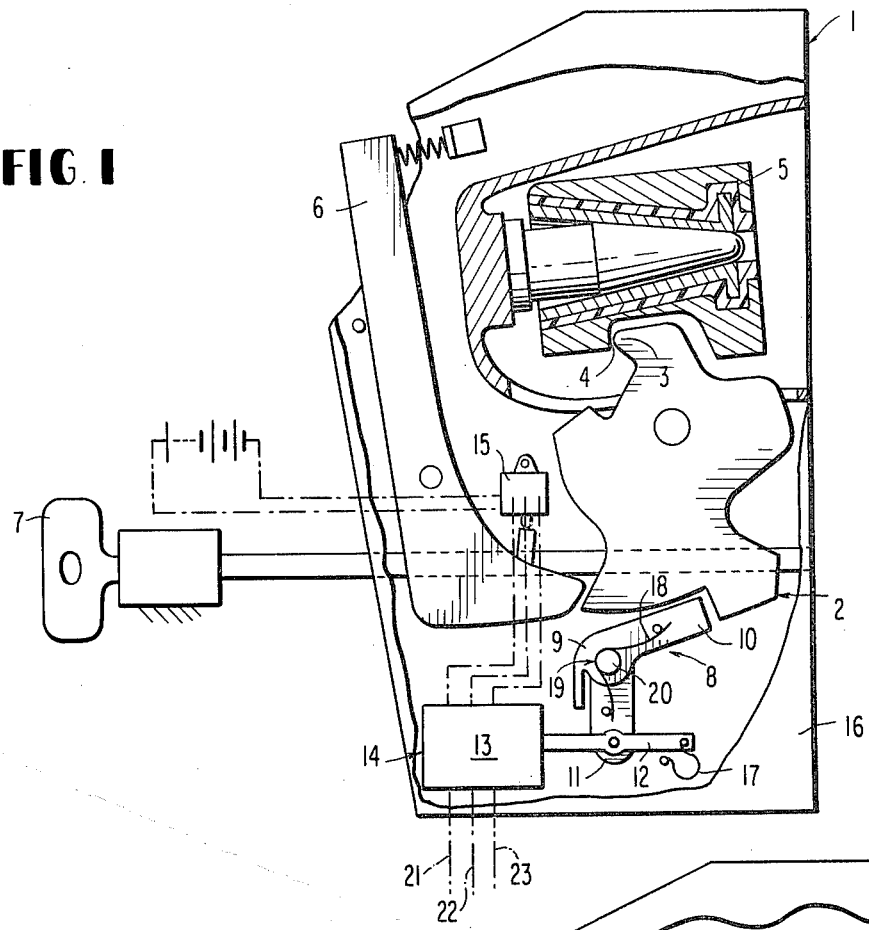
FIG. 1 is a somewhat schematic view, partially in cross section, of a first embodiment of a motor vehicle door lock with an additional magnetically actuated latching element in the latching position thereof.

A further latching element generally designated by reference numeral 8 in the form of a hinge-like, two-armed lever 9 is operatively connected with the catch member 2; one arm 10 of the two-armed lever 9 is supported at the catch element 2, when the door lock 1 secured according to FIG. 1, while the other arm 11 is operatively connected with the armature 12 of a pulse-controlled electromagnet 13, whereby the latter represents a servo device generally designated by reference numeral 14 which during rotation of the key 7 is controlled to reverse its position by way of a cam-actuated switch 15. The two end positions of the armature 12 and thereby secured by a spring 17 having a dead-center point which is connected with the armature 12 and the lock housing 16.

In order that a prelocking of the latching element 8 is made possible, the latching element 8 is adapted to deflect hinge-like against the force of a spring 18 when the catch element 2 abuts thereagainst during the closing of the door. The support forces are introduced directly into the lock housing 16 by the selected position of the lever 9 at the lock housing 16 without stressing or loading the servo device 14 by way of the fixed point 19 (bearing pin 20). The control commands for the electromagnet 13 are transmitted in a manner not illustrated in detail by way of lines 21, 22 and 23 to the servo devices coordinated to the other locks and/or flaps.

In the embodiment according to FIG. 4, the additional latching element 8 consists of a lever 24 which is constructed two-armed at least with the key-actuatable door lock on the driver side. One arm 25 is supported at the catch element 2 with a secured door lock 1 and the occurring forces are introduced into the lock housing 16 by way of the fixed point 19. The other arm 26 includes a guidance (not illustrated in detail) for a rod 28 provided with a pin 27 and transmitting the rotary movement of the key 7. During a rotation of the key 7 from the position illustrated in FIG. 4 toward the left, the arm 26 is lifted by the pin 27 against the force of a spring 29 enabling a prelocking, whence the arm 25 is pivoted downwardly out of the catch element 2.

The rod 28 is additionally provided with an extension 30, at which is pivotally connected the piston rod 21 of a vacuum-fed control valve 32. The suction pipe 33 of an internal combustion engine (not shown) serves as vacuum source. A line 26 leads to the control valve 32 under interconnection of a check valve 34 and of a reservoir tank 35. Two lines 37 and 38 start from the control valve 32 which lead to the servo devices generally designated by reference numeral 14 coordinated to the other locks and/or flaps, of which only one is illustrated for the sake of simplicity.

The servo device 14 represents a vacuum element 39 whose shifting rod 40 is pivotally connected at its free end 41 with the latching element 8. If one rotates the key 7 from the position illustrated in FIG. 4 toward the left, then the piston rod 31 is displaced upwardly, and the line 37 previously connected with the free atmosphere is supplied with vacuum whereas the line 38 is now brought into communication with the atmosphere. The shifting rod 40 therefore is displaced downwardly and moves the coordinated lever 24 out of the catch element 2. The last-mentioned lever 24 can also be prelocked in a conventional manner (not shown herein), whereby the lever 24 is able to deflect springily during the closing of the door and during the abutment of the catch element 2 by reason of the elasticity of the diaphragm of the vacuum element 39.

As a result of the particularly protected arrangement of the additional latching element which, as a rule, is encapsulated, the lock is safe in the best possible manner against manipulations. Even after the destruction of the windowpane and after the unlocking of the locking pin, the door cannot be opened since the additional latching device can be rendered inoperable only by means of a fitting key, i.e., can be disengaged only by means of a fitting key.

While we have shown and described two embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A latchable door lock for motor vehicles, comprising catch means operable to be blocked by a first latching means actuatable manually and by an additional latching means whose blocking effect can be cancelled only by means of a fitting key, characterized in that the additional latching means engages directly at the catch means without reaction on the first latching means, and in that key-controlled commands are transmitted by way of lines to servo means coordinated to the remaining doors and/or flaps which displace additional latching means thereof.

2. A door lock according to claim 1, characterized by means enabling a prelocking of the lock at least on the co-driver side.

3. A door lock according to claim 1 or 2, characterized in that the additional latching means, when acted upon by the catch means, is supported at a fixed point of a lock housing means without exerting any substantial force on at least one other part operatively connected with the additional latching means.

4. A door lock according to claim 3, characterized in that the additional part forms part of a servo means.

5. A door lock according to claim 4, characterized in that the additional part includes a control valve means.

6. A door lock according to claim 3, characterized in that the additional part includes a control valve means.

7. A door lock according to claim 3, characterized in that the fixed point is constituted by a bearing pin means of the pivotally arranged additional latching means which includes a lever.

8. A door lock according to claim 7, characterized in that the servo means includes a pneumatic element having a shifting rod operable to be shortened against spring force, which is pivotally connected at its free end with a latching pawl forming part of the additional latching means.

9. A door lock according to claim 8, characterized in that the pneumatic element is a vacuum element.

10. A door lock according to claim 7, characterized in that the servo means includes a pulse-controlled electromagnet means having an armature retained in the end positions thereof by a spring means having a dead-center point, said armature means being pivotally connected at an arm of a two-armed hinge-like lever forming part of the additional latching means, which is operable to be deflected against spring force.

11. A door lock according to claim 1 or 2, characterized in that the servo means includes a pneumatic element having a shifting rod operable to be shortened against spring force, which is pivotally connected at its free end with a latching pawl forming part of the additional latching means.

12. A door lock according to claim 1 or 2, characterized in that the servo means includes a pulse-controlled electromagnet means having an armature retained in the end positions thereof by a spring means having a dead-center point, said armature means being pivotally connected at an arm of a two-armed hinge-like lever forming part of the additional latching means, which is operable to be deflected against spring force.

* * * * *